United States Patent [19]

Svagr et al.

[11] Patent Number: 4,920,778

[45] Date of Patent: May 1, 1990

[54] ROLL STAND WITH ROLL RINGS PLACED FROM ONE SIDE ON A PAIR OF ROLL SUPPORT SHAFTS SUPPORTED ON TWO SIDES

[75] Inventors: Alexadr Svagr, Hilden; Hans Bogendörfer, Düsseldorf; Wolfgang Igelhorst, Mülheim/Ruhr, all of Fed. Rep. of Germany

[73] Assignee: SMS Schloemann-Siemag Aktiengesellschaft, Dusseldorf, Fed. Rep. of Germany

[21] Appl. No.: 133,292

[22] Filed: Dec. 16, 1987

[30] Foreign Application Priority Data

Dec. 16, 1986 [DE] Fed. Rep. of Germany ..... 3642903

[51] Int. Cl.[5] ..... B21B 37/08; B21B 31/00

[52] U.S. Cl. ..... 72/237; 72/245

[58] Field of Search ..... 72/237; 238, 239, 245

[56] References Cited

U.S. PATENT DOCUMENTS

| | | | |
|---|---|---|---|
| 3,626,738 | 4/1969 | Diolot | 72/245 X |
| 3,861,183 | 1/1975 | Fukui et al. | 72/245 X |
| 3,877,270 | 4/1975 | Marten | 72/245 X |
| 3,878,703 | 4/1975 | Mills et al. | 72/238 |
| 4,194,383 | 3/1980 | Huzyak | 72/245 |
| 4,653,304 | 3/1987 | Feldmann et al. | 72/239 |

FOREIGN PATENT DOCUMENTS

| | | | |
|---|---|---|---|
| 1198774 | 8/1965 | Fed. Rep. of Germany | 72/237 |
| 1287543 | 1/1969 | Fed. Rep. of Germany | 72/245 |
| 2036826 | 12/1970 | France | 72/245 |
| 1183573 | 3/1970 | United Kingdom | 72/245 |

*Primary Examiner*—W. Donald Bray
*Attorney, Agent, or Firm*—Toren, McGeady & Associates

[57] ABSTRACT

A roll stand with roll rings which are placed from one side or in a cantilivered manner on a pair of adjustable roll support shafts which are supported on two sides. Both roll support shafts have extension journals which project beyond the roll rings. Journal bearings can be slid onto and are fixable on the extension journals. The journal bearings have bearings housing which are connected with each other in a frictional engaging manner for absorbing rolling forces by means of piston-cylinder units which can be actuated by a pressure medium and are movable parallel to the direction of adjustment of the roll support shafts. On of the bearing housing is connected to the piston rods of the piston-cylinder unit and the other bearing housing, which supports the piston-cylinder units, sliding guide means for the piston rods. The roll stand further includes additional piston rods. The roll stand further includes additional piston-cylinder usits arranged between the two bearing housings. the cylinders and pistons of the additional piston-cylinder units are guided by the piston rods of the other piston-cylinder units which connect the bearing housings. The pistons of the second piston-cylinder units rest against one of the two bearing housings and the cylinders of the additional piston cylinder units rest against the other of the bearing housing. Pressure can be applied to the additional piston-cylinder units independently of the other piston-cylinder units.

3 Claims, 3 Drawing Sheets

ROLL STAND WITH ROLL RINGS PLACED FROM ONE SIDE ON A PAIR OF ROLL SUPPORT SHAFTS SUPPORTED ON TWO SIDES

BACKGROUND OF THE INVENTION

1. Field of the Invention

The present invention relates to a roll stand with roll rings which are placed from one side or in a cantilevered manner on a pair of adjustable roll support shafts which are supported on two sides. Both roll support shafts have extension journals which project beyond the roll rings. Journal bearings can be slid onto and are fixable on the extension journals. The journal bearings have bearing housings which are connected with each other in a frictionally engaging manner for absorbing rolling forces by means of piston-cylinder units which can be actuated by a pressure medium and are movable parallel to the direction of adjustment of the roll support shafts, wherein one of the bearing housings is connected to the piston rods of the piston-cylinder unit and the other bearing housing, which supports the piston-cylinder unit, has sliding guide means for these piston rods.

2. Description of the Prior Art

Roll stands of this type, even though the roll rings are supported in a cantilevering mass, can absorb substantially greater rolling forces than roll stands which do not have the bearing housings for the journal bearings which can be slid onto and fixed on the extension journals. The pressure-actuated piston-cylinder units connected to the bearing housings make it possible to absorb a substantial portion of the rolling forces when the roll rings are supported from one side. In the past, this had only been possible when the roll or roll rings had been supported on two sides on both sides of the roll or roll ring in normal roll stands having two roll housings connected by means of transverse support members. Thus, it is made possible to use the arrangement of roll rings from one side even in those cases in which significantly greater rolling forces occur than, for example, in wire finishing blocks, without increasing the bearing sizes and, consequently, the roll diameters.

In addition, it is possible to use roll stands having especially great stiffnesses, such as, those with eccentric sleeve adjustment. Also, since such roll stands have relatively small dimensions, the roll stands can be placed more closely together in rolling direction. The resulting compact arrangement makes it easier to modernize existing rolling trains where space is limited.

However, in the practical operation of such roll stands in rolling trains, as disclosed in German Offenlegungsschrift No. 34 07 207, it has been found that, when the rolling stock section enters the roll gap, the rolling stock section forces one or both bearing houses outwardly away from the rolling gap by a distance corresponding to the bearing play between the bearing housing and the journal portion of the roll support shaft, and that, after the end of the rolling stock section has left the roll gap, the bearing housing or housings return into their original position as a result of their weight. This process leads to undesirable impacts.

In addition, due to the elasticity of the roll support shafts themselves and of the structural components of the system for applying pressure thereon, both journal portions of the roll support shafts which carry the rolls resiliently return by a certain distance toward the roll gap after the end of the rolling stock section has left the roll gap, so that the effect of the above-described impacts is further increased.

It is, therefore, the primary object of the present invention to provide a roll stand in which the above-described disadvantages are avoided and, consequently, the stiffness of the roll stand is increased.

SUMMARY OF THE INVENTION

In accordance with the present invention, the roll stand of the type described above includes additional piston-cylinder units arranged between the two bearing housings. The cylinders and pistons of the additional piston-cylinder units are guided by the piston rods of the other piston-cylinder units which connect the bearing housings. The pistons of the additional piston-cylinder units rest against one of the two bearing housings and the cylinders of the additional piston-cylinder units rest against the other of the bearing housings. Pressure can be applied to the additional piston-cylinder units independently of the other piston-cylinder units.

In accordance with a feature of the present invention, the piston-cylinder units whose piston rods connect the two bearing housings and the piston-cylinder units which are arranged between the bearing housings have the same working surface areas and are connected to a common pressure generating unit, but the pressure acting on the respective piston-cylinder units is individually adjustable and the respective piston-cylinder units can be individually separated from the pressure generating unit and can be closed individually.

In accordance with another feature of the present invention, a displacement pickup may be provided which monitors the spacing between the bearing housings and which is capable of influencing a position adjusting and controlling device for the piston-cylinder units whose piston-rods connect the bearing housings.

In accordance with another feature of the present invention, the piston-cylinder units arranged between the bearing housings may be pairs of axially spaced apart piston-cylinder units which can be actuated simultaneously and together with pressure.

Finally, the invention provides that the piston-cylinder units may be arranged in a roll housing which is rigidly connected to the roll stand, wherein the bearing housings define recesses which are open toward the roll stand and surround the cylinders and the piston rods of the piston-cylinder units and which define contact seat surfaces for the cylinders and/or the pistons of the piston-cylinder units and include releasable fixing elements for the latter.

In such a roll stand according to the present invention, the two bearing housings can be pretensioned against the rolling pressure as is the case in known constructions for keeping constant the adjusted width of the rolling gap, while, by applying pressure to the piston-cylinder units whose piston rods connect the bearing housings as well as to the piston-cylinder units which are arranged between the bearing housings, a bracing of the bearing housings can be achieved which corresponds to a bracing which is achievable by screws. In other words, when the pressure in the piston-cylinder unit whose piston rods connect the bearing housings increases due to the rolling pressure, the piston rods expand and cause a corresponding decrease of the pressure in the piston-cylinder units arranged between the bearing housings. This can be achieved in a structurally simple manner making it possible that, before the rolling stock section enters the roll gap, the piston-cylinder units whose piston rods connect the bearing housings and the piston-cylinder units arranged between the bearing housings can be separated from the common pressure generating unit and can be closed individually.

On the other hand, prior to beginning rolling and when the appropriate pressure is applied to all piston-cylinder units, the adjustment movements of the bearing housings are carried out with positive balancing, wherein the pretensioning of the bearing housings relative to each other is maintained, i.e., the piston rods remain under tensile load and the piston-cylinder units arranged between the bearing housings exert a pressure on both bearing housings. This pressure further means that the bearing play of the journal portions of the roll support shafts can be eliminated when the piston-cylinder units arranged between the bearing housings are dimensioned in such a way that the pressure generated by these units on the bearing housings is slightly greater than the tensioning pressure exerted by the piston-cylinder units connecting the bearing housings and, consequently, a positive balancing of the bearing housings is achieved.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DETAILED DESCRIPTION OF THE INVENTION

Figure 1:
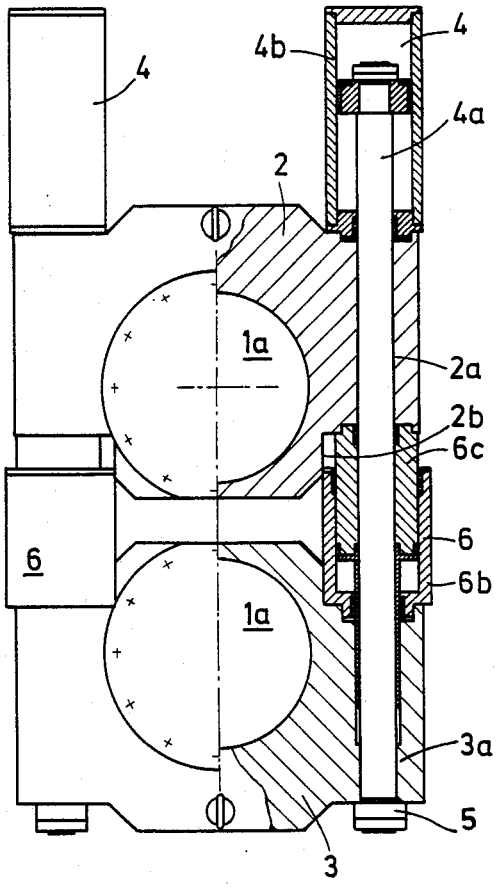
FIG. 1 is a front elevational view, partly in section, of a roll stand with an arrangement of bearing housings with piston-cylinder units according to the present invention.
Figure 2:
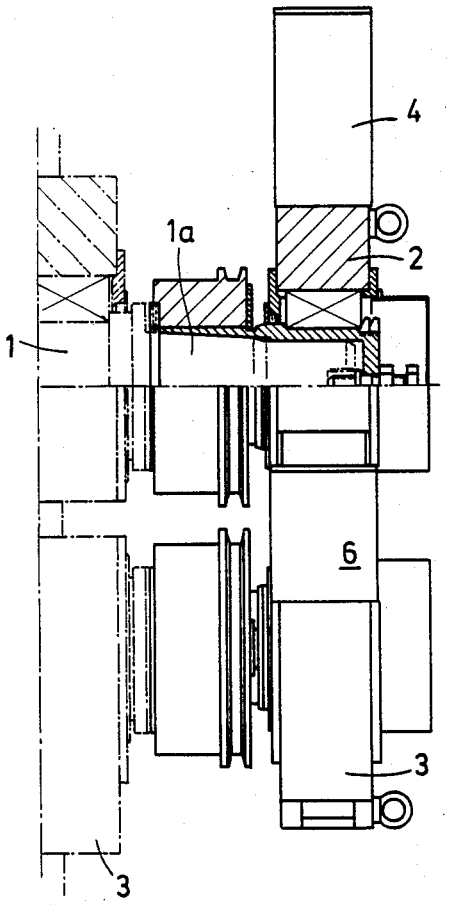
FIG. 2 is a side view, also partly in section, of the roll stand of FIG. 1.

As illustrated in FIGS. 1 and 2 of the drawing, bearing housings or chocks 2 and 3 which receive journal portions 1*a* of roll support shafts 1 are connected through piston rods 4*a* of piston-cylinder units 4. An end face of a cylinder 4*b* of each piston-cylinder unit 4 rests on one of the bearing housings 2. Piston rods 4*a* extend through a bore 2*a* of this bearing housing and through another bore 3*a* of the bearing housing 3 and are fixed by means of screws 5. Additional piston-cylinder units 6 are arranged between the bearing housings 2 and 3. As illustrated in the drawing, the end face of the piston 6*c* of each piston-cylinder unit 6 rests against the bearing housing 2 and an end face of cylinder 6*b* rests against the other bearing housing 3. The outer surface of cylinder 6*b* is slidingly guided in guide means 2*b* of the bearing housing 2; also, cylinder 6*b* and piston 6*c* of this piston-cylinder unit slides on the piston rod 4*a* of piston-cylinder unit 4 which piston rod 4*a* extends centrally through appropriate bores provided in piston-cylinder unit 6.

Figure 3:
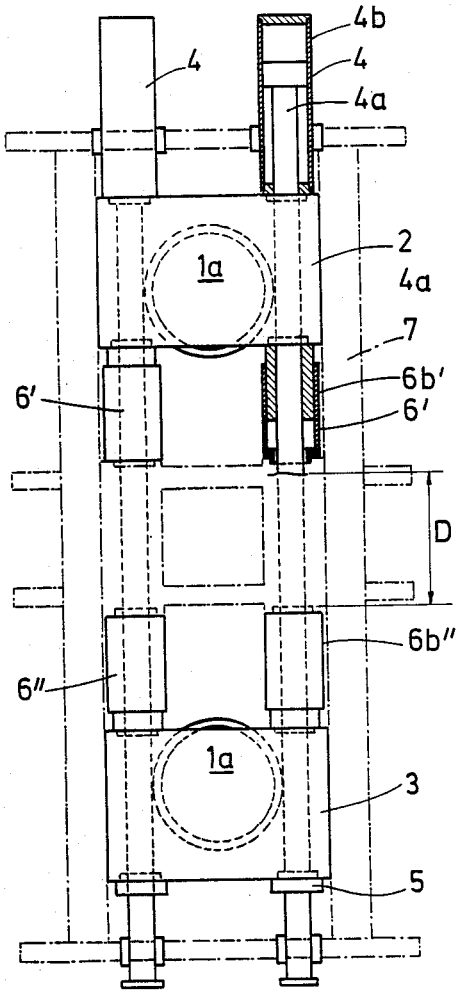
FIG. 3 is a front elevational view, partly in section, of another embodiment of the roll stand according to the present invention.
Figure 4:
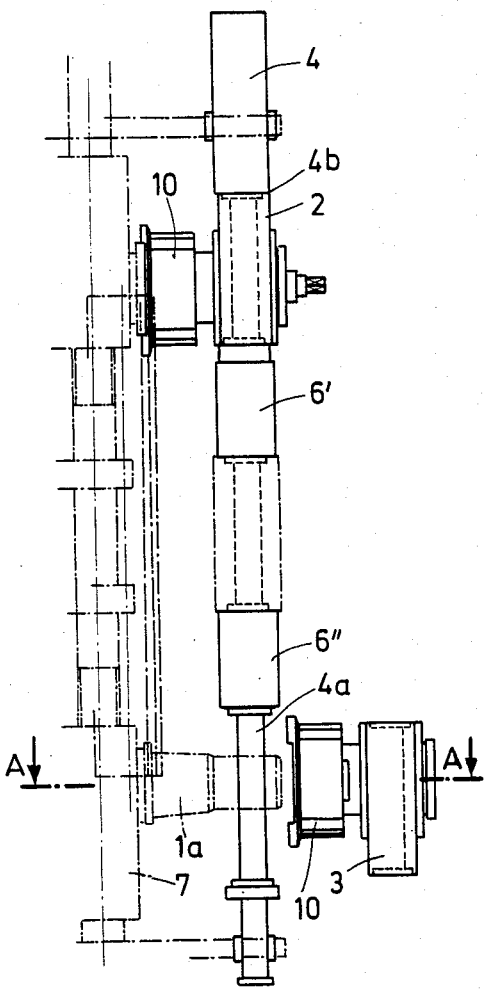
FIG. 4 is a side view of the roll stand of FIG. 3.

In the embodiment illustrated in FIGS. 3 and 4 of the drawing, pairs of piston-cylinder units are arranged between the bearing housings 2 and 3 axially spaced apart by a distance D. The pairs of piston-cylinder units are arranged in a support frame 7 which is illustrated in dash-dotted lines. This arrangement makes it possible to use piston-cylinder units with short strokes even if the width of the roll gap is great.

Figure 5:
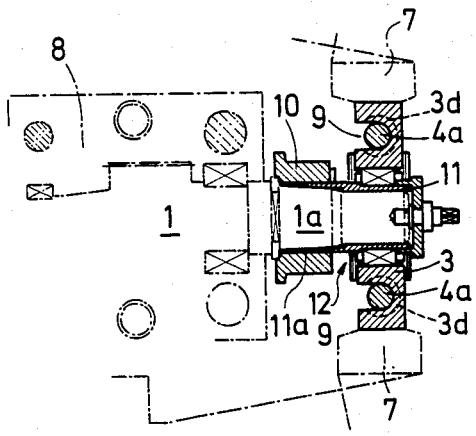
FIG. 5 is a sectional view taken along sectional line A—A of FIG. 4.

FIG. 5 of the drawing shows that, in the embodiment of FIGS. 3 and 4, the bearing housings 2 and 3 have recesses with contact seat surfaces 3*d*, which recesses are open toward the roll stand 8 and surround the cylinders 4*b* and 6*b*' and 6*b*'' and the piston rods 4*a* of the piston-cylinder units 4. These recesses make it possible to remove the bearing housings 2 and 3 together with the roll rings 10 from the journal portions 1*a* of the roll support shafts 1, without having to separate the connection of the piston-cylinder units 4 and 6 with the support frame 7. The piston-cylinder units 4 and 6 as well as the support frame 7 remain connected to the roll stand 8. During this procedure, roll ring 10 is supported by a sleeve-like extension 11*a* of an inner ring 11 of journal bearing 12.

Figure 6:
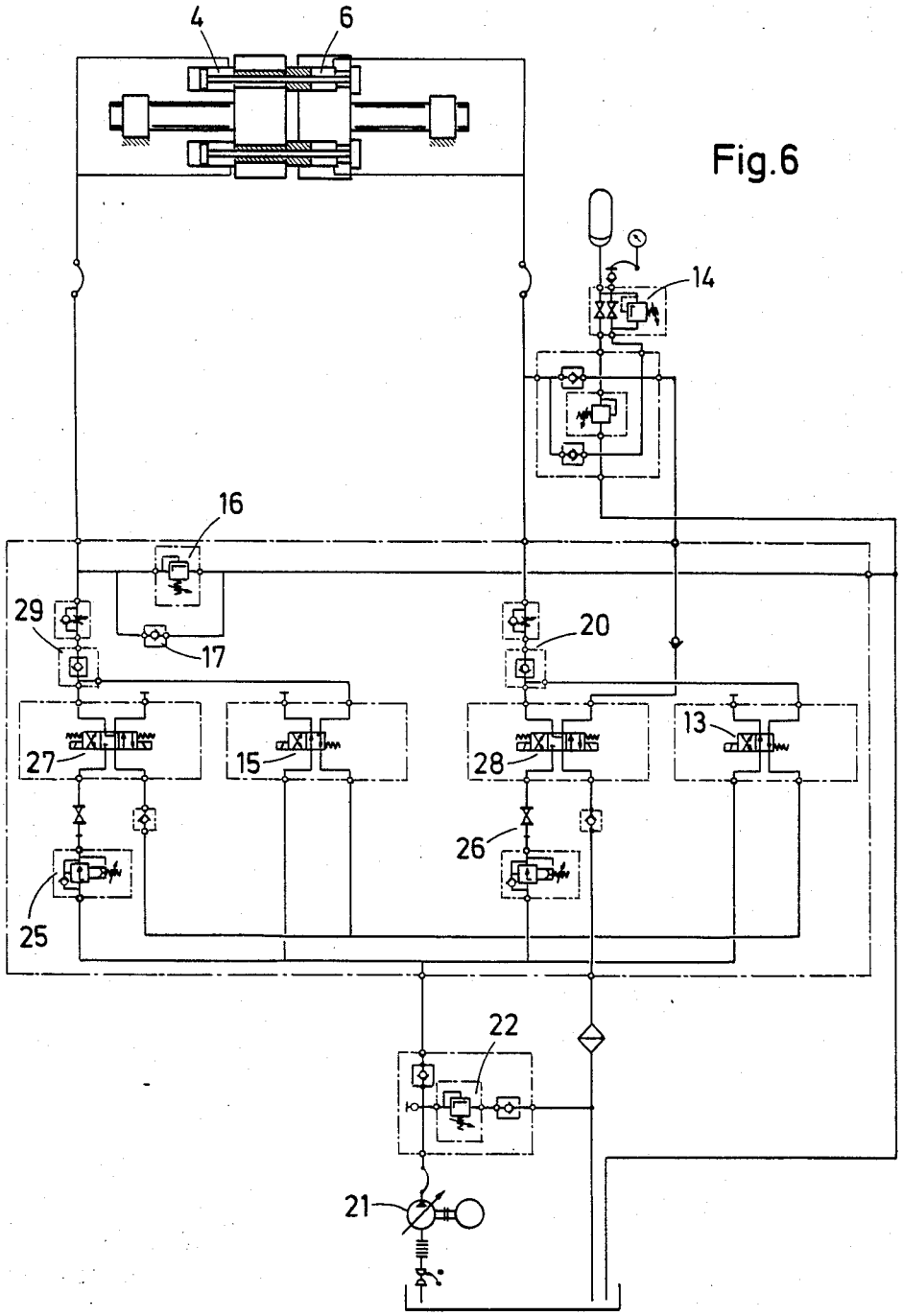
FIG. 6 is a hydraulic diagram of a pressure medium control device for operating the roll stand according to the present invention.

The operation of the pressure medium control device for the piston-cylinder unit shall now be explained with the aid of FIG. 6.

The pressure to be applied is generated by a pump 21 secured by a pressure relief valve 22. A magnet b of a solenoid valve 28 applies pressure to the piston-cylinder unit 6. The pressure is regulated at pressure-reducing valve 26. A possibility for relief is provided for a hydraulically controlled check valve 20 via a directional control valve 13. A pressure increase due to mass and spring forces which occur when the rolling stock section leaves the roll gap can be limited by means of the damping reservoir 14.

Pressure is applied to the piston-cylinder units 4 by actuating magnet b of solenoid valve 27, the pressure regulation being carried out at pressure-reducing valve 25. A possibility for relief is provided by a hydraulically controlled check valve 29 via directional control valve 15. Any pressure increase occurring during rolling can be limited by means of pressure relief valve 16. A possibility for additional intake is provided by means of check valve 17 when the rolling stock section leaves the rolling gap.

When operation is started, a pressure application to piston-cylinder units 6 acts to bridge the bearing play and a pressure application to piston-cylinder units 4 acts to create the pretension through piston rods 4*a*. The hydraulically controlled check valves 29 and 20 serve to maintain the respectively adjusted pressure within the piston-cylinder units and the pretensioned pressure medium volumes act as stacks of springs would. After each pass, the piston-cylinder units 4 and 6 are relieved by opening the hydraulically controlled check valves 29 and 20; subsequently, the above-described procedure is repeated.

A displacement pickup which monitors the spacing between the bearing housings 2 and 3 and position adjustment and control devices for the piston-cylinder units 4 which devices are influenced by the displacement pickup can be used for regulating the operation if valve 27 is replaced by a power-assisted valve and a pressure reservoir is arranged in the feedline to this pressure-assisted valve. In this case, pressure valve 25 is omitted. The power-assisted valve is used for regulating the pressure in the piston-cylinder unit 4 in accordance with the requirements, i.e., the device can compensate displacement errors caused during rolling, for example, by elastic deformations.

While specific embodiments of the invention have been shown and described in detail to illustrate the application of the inventive principles, it will be understood that the invention may be embodied otherwise without departing from such principles.

We claim:

1. In a roll stand including roll rings placed from one side on a pair of adjustable roll shafts which are supported on two sides, wherein both roll support shafts have extension journals which project beyond the roll rings and journal bearings which can be slid onto and are fixable on the extension journals, and wherein the journal bearings have bearing housings, first piston-cylinder units for acting on the bearing housings against the direction of the rolling forces, the first piston-cylinder units having piston rods and being actuated by a pressure medium and movable parallel to the direction of adjustment of the roll support shafts, one of the bearing housings being rigidly connected to the piston rods of the first piston-cylinder units and the other bearing housing being rigidly connected to the cylinders of the first piston-cylinder units, such that the bearing housings are connected to each other in a frictionally engaging manner, the improvement comprising second piston-cylinder units arranged between the two bearing housings, the cylinders and pistons of the second piston-cylinder being slidingly guided by the piston rods of the first piston-cylinder units which connect the bearing housings, the pistons of the second piston-cylinder units resting against one of the two bearing housings and the cylinders of the second piston-cylinder units resting against the other of the bearing housings, wherein the first piston-cylinder units whose piston rods connect the two bearing housings and the second piston-cylinder units which are arranged between the bearing housings have working surface areas of equal size and are connected to a common pressure generating unit, means for individually adjusting the pressure acting on the first and second piston-cylinder units and means for individually separating the first and second piston-cylinder units from the pressure generating units and means for individually closing the first and second piston-cylinder units.

2. The roll stand according to claim 1, wherein pairs of second axially spaced-apart piston-cylinder units are arranged between the bearing housings, the roll stand further comprising means for pressure-actuating each pair of second piston-cylinder units simultaneously and together.

3. The roll stand according to claim 1, wherein a roll housing is rigidly connected to the roll stand, the first and second piston-cylinder units being arranged in the roll housing, and wherein the bearing housings define recesses which are open toward the roll stand and surround the piston rods and the first and second piston-cylinder units, the recesses defining contact seat surfaces for the first and second piston-cylinder units and including releasable fixing elements for the first and second piston-cylinder units.

* * * * *